US010780475B2

(12) United States Patent
Boehm et al.

(10) Patent No.: US 10,780,475 B2
(45) Date of Patent: Sep. 22, 2020

(54) LUBRICATION USING SPRAY NOZZLES HAVING MULTIPLE OIL INLET OPENINGS

(71) Applicant: Primetals Technologies Austria GmbH, Linz (AT)

(72) Inventors: Martin Boehm, Linz (AT); Thomas Braidt, Linz (AT); Gernot Dirisamer, Tollet (AT); Konrad Krimpelstaetter, Österreich (AT); Daniel Vipavc, Linz (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 497 days.

(21) Appl. No.: 15/109,067

(22) PCT Filed: Nov. 18, 2014

(86) PCT No.: PCT/EP2014/074844
§ 371 (c)(1),
(2) Date: Jun. 29, 2016

(87) PCT Pub. No.: WO2015/104082
PCT Pub. Date: Jul. 16, 2015

(65) Prior Publication Data

US 2016/0325327 A1 Nov. 10, 2016

(30) Foreign Application Priority Data

Jan. 8, 2014 (EP) ..... 14150400

(51) Int. Cl.
*B21B 45/02* (2006.01)
*B05B 7/04* (2006.01)
(Continued)

(52) U.S. Cl.
CPC ..... *B21B 45/0251* (2013.01); *B05B 7/0483* (2013.01); *B05B 7/0846* (2013.01);
(Continued)

(58) Field of Classification Search
CPC . B05B 13/0278; B05B 7/0483; B05B 7/0846; B05B 7/0876; B21B 45/0233; B21B 45/0251
See application file for complete search history.

(56) References Cited

U.S. PATENT DOCUMENTS 2,465,619 A 3/1949 Veit
2,959,249 A * 11/1960 Gothberg ..... F16N 7/32 184/6.22
(Continued)

FOREIGN PATENT DOCUMENTS

CN 1518483 A 8/2004
CN 1964801 A 5/2007
(Continued)

OTHER PUBLICATIONS

Machine Translation of WO 2012079785, Translated Mar. 15, 2018, 6 Pages.*
(Continued)

*Primary Examiner* — Gregory D Swiatocha
(74) *Attorney, Agent, or Firm* — Ostrolenk Faber LLP

(57) ABSTRACT

During the rolling of a metallic flat rolling stock (1) in a roll stand (2), lubricating oil (5) is sprayed onto the rolling stock (1) and/or at least one roll (3,4) of the roll stand (2) by multiple spray nozzles (7) arranged beside one another. In each case, a mixing chamber (8) of a spray nozzle (7) is fed with a respective quantity of lubricating oil (5) via respective multiple oil inlet openings (9). The respective mixing chamber (8) is fed with compressed air (11) via respectively one air inlet opening (10). Compressed air (11) atomizes the lubricating oil (5) in the respective mixing chamber (8) to form an aerosol and, via respectively at least one nozzle outlet (12), is sprayed onto the rolling stock (1) and/or the at least one roll (3,4) of the roll stand (2).

18 Claims, 4 Drawing Sheets

(51) Int. Cl.
*B05B 7/08* (2006.01)
*B05B 13/02* (2006.01)

(52) U.S. Cl.
CPC ..... *B05B 7/0876* (2013.01); *B05B 13/0278* (2013.01); *B21B 45/0233* (2013.01)

(56) References Cited

U.S. PATENT DOCUMENTS

| | | | | | |
|---|---|---|---|---|---|
| 3,763,679 | A * | 10/1973 | Lane | B21B 27/10 | 72/12.5 |
| 3,789,641 | A * | 2/1974 | Miller | F16N 7/34 | 72/45 |
| 4,103,827 | A * | 8/1978 | Kumazawa | B01F 5/20 | 239/427 |
| 4,120,455 | A | 10/1978 | Wilmotte | 239/429 | |
| 4,221,185 | A * | 9/1980 | Scholes | B05B 5/14 | 118/634 |
| 4,802,630 | A * | 2/1989 | Kromrey | B01F 5/0413 | 239/428 |
| 5,282,376 | A * | 2/1994 | Steele | B21B 45/0251 | 72/41 |
| 7,266,984 | B2 * | 9/2007 | Cerv | B21B 27/10 | 72/236 |
| 8,544,608 | B2 * | 10/2013 | Vervaet | B21B 27/10 | 184/6.26 |
| 9,254,513 | B2 * | 2/2016 | Pawelski | B21B 27/10 | |
| 9,314,827 | B2 * | 4/2016 | Atalla | B05B 1/046 | |
| 2004/0232258 | A1 | 11/2004 | Cerv et al. | | |
| 2007/0099135 | A1 * | 5/2007 | Schubach | F23K 5/04 | 431/37 |
| 2010/0258380 | A1 | 10/2010 | Vervaet et al. | | |
| 2011/0111124 | A1 | 5/2011 | Pawelski et al. | | |
| 2013/0019647 | A1 * | 1/2013 | Inoue | F16N 7/34 | 72/43 |
| 2013/0298627 | A1 | 11/2013 | Atalla et al. | | |
| 2015/0013419 | A1 * | 1/2015 | Braidt | B21B 27/10 | 72/236 |

FOREIGN PATENT DOCUMENTS

| | | | | |
|---|---|---|---|---|
| CN | 101821026 | A | 9/2010 | |
| CN | 102083559 | A | 6/2011 | |
| CN | 103249504 | A | 8/2013 | |
| DE | 10 2008 050392 | A1 | 12/2009 | |
| EP | 2 465 619 | A1 | 6/2012 | |
| JP | S52-144812 | | 12/1977 | |
| SU | 988880 | A1 | 1/1983 | |
| SU | 1579594 | A1 | 7/1990 | |
| WO | WO 02/060592 | A1 | 8/2002 | |
| WO | WO 2009156057 | A2 * | 12/2009 | B21B 27/10 |
| WO | WO 2012079785 | A1 * | 6/2012 | B05B 1/046 |

OTHER PUBLICATIONS

Machine Translation of WO 2009156057, Translated Mar. 15, 2018, 7 Pages.*

Chinese Office Action, dated Jan. 2, 2018, issued in corresponding Chinese Patent Application No. 201480072774.3, including the English translation. Total 20 pages.

International Search Report dated Feb. 5, 2015 issued in corresponding International patent application No. PCT/EP2014/074844.

International Preliminary Report on Patentability dated Dec. 10, 2015 issued in corresponding International patent application No. PCT/EP2014/074844.

Office Action dated Nov. 13, 2017 issued in corresponding Japanese Patent Application No. 2016-545279.

First Office Action with Search Report dated May 17, 2017 in corresponding Chinese Patent Application No. 201480072774.3 (with English language translation)(total 23 pages).

Russian Office Action dated Jun. 29, 2018.

* cited by examiner

LUBRICATION USING SPRAY NOZZLES HAVING MULTIPLE OIL INLET OPENINGS

CROSS-REFERENCE TO RELATED APPLICATIONS

The present application is a 35 U.S.C. §§ 371 national phase conversion of PCT/EP2014/074844, filed Nov. 18, 2014, which claims priority of European Patent Application No. 14150400.1, filed Jan. 8, 2014, the contents of which are incorporated by reference herein. The PCT International Application was published in the German language.

BACKGROUND OF THE INVENTION

The present invention relates to a method for applying a lubricating oil to flat metal rolling stock and/or at least one roll of a roll stand during the rolling of the rolling stock in the roll stand by means of a plurality of spray nozzles arranged adjacent to one another.

In each case, a mixing chamber of a spray nozzle is fed with a respective quantity of lubricating oil via one oil inlet opening in each case.

The respective mixing chamber is fed with compressed air via at least one air inlet opening in each case.

The lubricating oil is atomized in the respective mixing chamber by means of the compressed air to form an aerosol and is sprayed onto the rolling stock and/or the at least one roll of the roll stand via at least one nozzle outlet of the respective spray nozzle in each case.

The present invention further relates to a device for applying a lubricating oil to flat metal rolling stock and/or at least one roll of a roll stand during the rolling of the rolling stock in the roll stand, wherein the device has a spray bar which extends parallel to an axis of rotation of the at least one roll of the roll stand and a plurality of spray nozzles arranged adjacent to one another on the spray bar.

Each of the spray nozzles has a mixing chamber which is fed with a respective quantity of lubricating oil via one oil inlet opening in each case.

The respective mixing chamber has in each case at least one air inlet opening via which the respective mixing chamber is fed with compressed air.

Each of the spray nozzles has at least one nozzle outlet via which the lubricating oil atomized in the respective mixing chamber to form an aerosol is sprayed onto the rolling stock and/or the at least one roll of the roll stand.

A method and a device of this kind are known. Reference is made, purely by way of example, to US 2010/0 258 380 A1 or also to EP 2 465 619 A1.

The lubrication of the roll gap during cold rolling is extremely important for the stability and quality of the rolling process. Conventionally, an oil/water emulsion is used for lubricating the roll gap. More recently, however, it has also already become known to spray pure lubricating oil, for example in the form of base oil, onto the rolling stock and/or the at least one roll instead of an oil/water emulsion.

During the spraying operation, it is necessary to apply the lubricating oil evenly over the entire width that is to be lubricated. Viewed over the length of the rolling stock, however, the quantity of lubricating oil can vary. Depending on the rolling conditions, such as, for example, width of the rolling stock, rolling speed, reduction per pass, rolling force, etc., the quantity of lubricating oil applied to the rolling stock and/or the at least one roll in the case of a specific roll stand can vary between 35 ml/minute and 2000 ml/minute.

Referred to an individual spray nozzle, the quantity of lubricating oil can vary between 2 ml/minute and 60 ml/minute. Referred to an individual spray nozzle, it is therefore necessary to apply the quantity of lubricating oil reliably to the rolling stock and/or the at least one roll over a wide range of adjustment (minimum-to-maximum ratio approx. 1:30).

A further problem is that the oil inlet openings may become blocked. If such a blockage occurs, a part of the rolling stock and/or of the roll gap will be lubricated only to an inadequate extent. This has significantly negative effects on the rolling process as a consequence.

SUMMARY OF THE INVENTION

The object of the present invention is to provide possible ways by means of which the requisite range of adjustment can be guaranteed in a simple and reliable manner and in addition to avoid blockages as far as possible or at least to limit their effects.

According to the invention, a method of the type cited in the introduction is embodied in that in each case a mixing chamber of a spray nozzle is fed with the respective quantity of lubricating oil not only via a single oil inlet opening in each case, but via a plurality of oil inlet openings in each case.

This makes it possible for example to feed a respective sub-quantity of lubricating oil to each of the oil inlet openings independently of one another. Thus, for a relatively small quantity of lubricating oil, for example, that quantity can be supplied via just one or two of the oil inlet openings for a relatively large quantity of lubricating oil, that quantity of oil can be supplied via all or almost all of the oil inlet openings. Furthermore, blockages usually occur independently of one another. Even if a blockage of one of the oil inlet openings were to occur, the spray nozzle can continue to be fed with the lubricating oil via the remaining oil inlet openings. In an individual case, there is a possibility that in the event of blockage of one of the oil inlet openings, only a reduced range of adjustment will be realizable thereafter. However, a total failure of the oil supply can be avoided virtually with certainty.

Preferably, the spray nozzles are embodied as cylindrical, such that they have a respective longitudinal axis. In this case, the nozzle outlets are preferably arranged at one of the axial ends of the respective spray nozzle and the at least one air inlet opening in each case is arranged at the other axial end of the respective spray nozzle. This results in a simple configuration of the spray nozzles in constructional terms and a simple and stable guidance of the compressed air in the spray nozzle, in particular in the mixing chamber.

Referred to one of the spray nozzles in each case, one of the oil inlet openings is arranged at a defined axial position, viewed in the direction of the longitudinal axis. Preferably, at least one other of the oil inlet openings is arranged at the same axial position, viewed in the direction of the longitudinal axis. This enables the axial position for the oil inlet openings to be determined in a consistently optimal manner.

Preferably, the oil inlet openings arranged at the defined axial position are arranged evenly distributed, viewed around the longitudinal axis. This enables a particularly good atomization of the lubricating oil to be achieved.

Preferably, the lubricating oil is fed to the respective mixing chamber in a flow-controlled manner. This enables the quantity of lubricating oil to be dispensed particularly efficiently.

In practice it has proved advantageous if the compressed air fed to the respective mixing chamber has a pressure that lies between 0.1 bar and 10 bar. The pressure can lie in particular between 1.0 bar and 6.0 bar.

Preferably, a pressure at which the compressed air is fed to the respective mixing chamber is set as a function of the quantity of lubricating oil fed to the respective mixing chamber. This enables the formation of the aerosol by a selected pressure of the compressed air to be optimized. In particular, the pressure at which the compressed air is fed to the respective mixing chamber can increase in line with the quantity of lubricating oil fed to the respective mixing chamber.

In practice it had furthermore proved advantageous if the at least one air inlet opening has a diameter that lies between 0.01 mm and 5 mm. Preferably, the diameter can lie between 3 mm and 5 mm, in particular around at least 4 mm.

In practice it has furthermore proved advantageous if the oil inlet openings have a diameter that lies between 0.1 mm and 1.0 mm. The diameter can lie in particular between 0.4 mm and 0.6 mm.

Preferably, each of the nozzle outlets is embodied as slit-shaped. This enables in particular a relatively wide fan-like jet to be produced.

In practice it has furthermore proved advantageous if the nozzle outlets are spaced apart from the rolling stock and/or the working roll onto which the lubricating oil is sprayed at a distance that lies between 100 mm and 400 mm. The distance can lie in particular between 150 mm and 300 mm.

In practice it has furthermore proved advantageous if the spray nozzles are spaced apart from one another by a distance that lies between 50 mm and 300 mm. The distance can lie in particular between 100 mm and 200 mm.

The lubricating oil sprayed onto the rolling stock and/or the at least one roll by one of the spray nozzles in each case is sprayed onto a respective subarea of the rolling stock and/or of the at least one roll. Preferably, the subareas assigned to immediately adjacent spray nozzles have a degree of overlap that lies between 0% and 50%. At a degree of overlap of 0%, the subareas only adjoin one another, without overlapping. At a degree of overlap of 50%, the center of one subarea lies at the border of the other subarea, and vice versa.

According to the invention, the device, analogously to the method, is embodied in that in each case a mixing chamber of a spray nozzle is fed with the respective quantity of lubricating oil not just via a single oil inlet opening in each case, but via a plurality of oil inlet openings in each case.

The advantageous embodiments of the device correspond to those of the method. In the interest of avoiding repetitions, reference is therefore made to the foregoing statements in relation to the method.

The above-described characteristics, features and advantages of this invention, as well as the manner in which these are achieved, will become clearer and more readily understandable taken in conjunction with the following description of the exemplary embodiments, which are explained in more detail with reference to the schematic drawings, in which:

DESCRIPTION OF EMBODIMENTS

Figure 1:
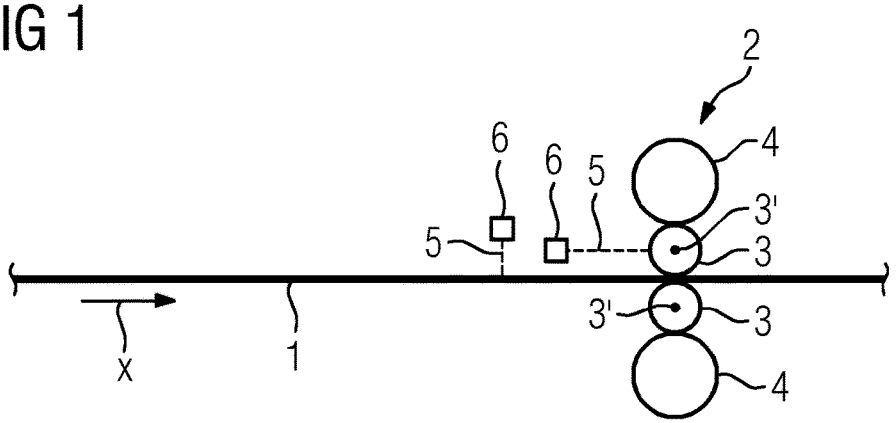
FIG. 1 schematically shows a roll stand and a flat rolling stock from the side, FIG. 2 schematically shows the roll stand and the rolling stock of FIG. 1 from above.
Figure 2:
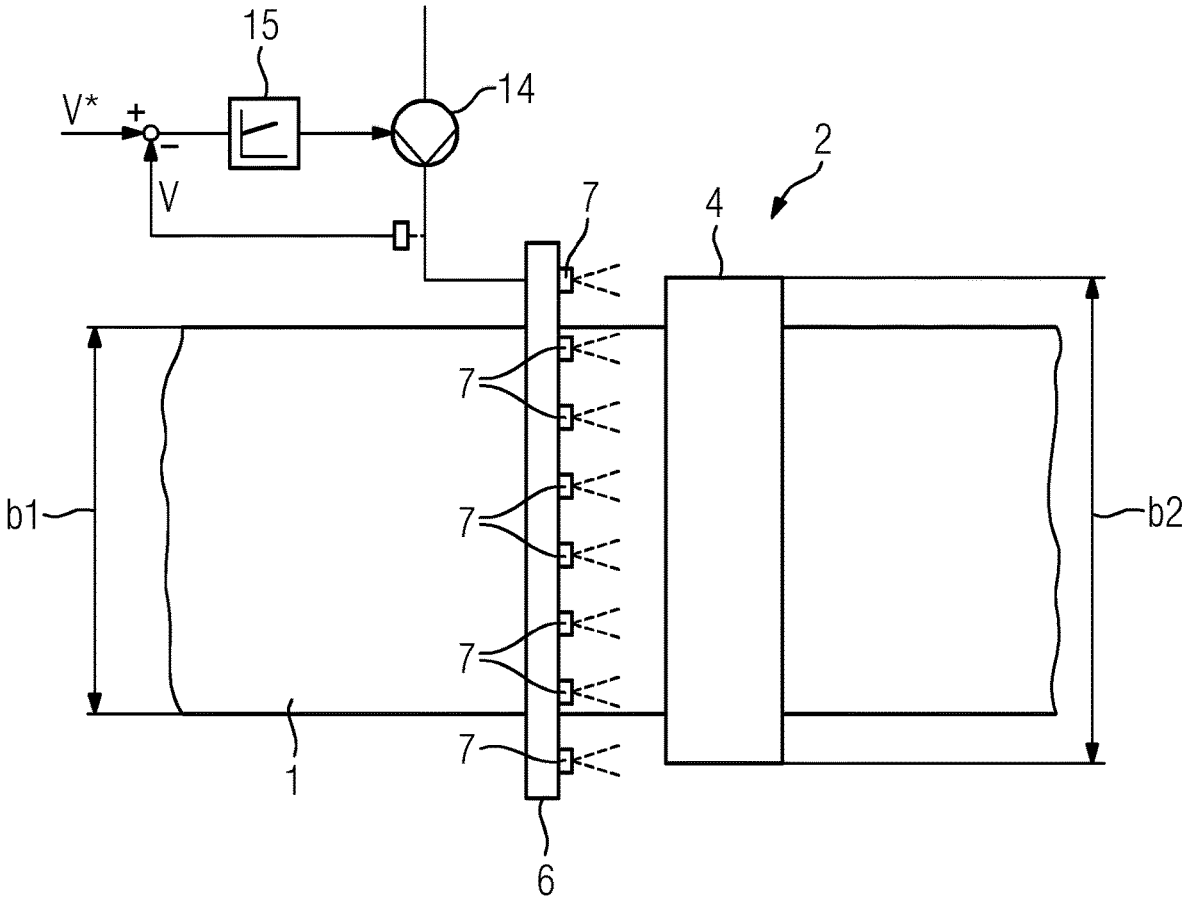

According to FIGS. 1 and 2, a flat metal rolling stock 1 is rolled in a roll stand 2. During the rolling process, the rolling stock 1 is conveyed in a transport direction x. The roll stand 2 has at least working rolls 3. Often the roll stand 2 additionally has backup rolls 4 and, where necessary also, further rolls not shown in the Figures.

When the rolling stock 1 is rolled in the roll stand 2, a lubricating oil 5 is applied to the rolling stock 1 and/or at least one of the rolls 3, 4 of the roll stand 2, as illustrated in FIGS. 1 and 2. According to the view shown in FIG. 1, lubricating oil 5 is applied to the top side of the rolling stock 1 and to the upper working roll 3. It is however sufficient, insofar as the top side of the rolling stock 1 is concerned, for lubricating oil 5 to be applied to the top side of the rolling stock 1 or to the upper working roll 3. It would furthermore be possible, alternatively or in addition to the application of the lubricating oil 5 to the top side of the rolling stock 1 and/or to the upper working roll 3, to apply lubricating oil 5 to another roll 4 arranged above the rolling stock 1, for example to the upper backup roll 4 or (in the case of a six-high stand) to the upper intermediate roll.

According to FIGS. 1 and 2, a device for applying the lubricating oil 5 to the top side of the rolling stock 1 and/or at least one roll 3, 4 arranged above the rolling stock 1 has a spray bar 6. The spray bar 6 extends parallel to a respective axis of rotation 3' of the working rolls 3. A plurality of spray nozzles 7 are arranged adjacent to one another along the spray bar 6. Collectively, the spray nozzles 7 are usually identical in construction. The design of one of the spray nozzles 7 is explained in more detail in the following with reference to FIGS. 3 and 4.

Furthermore, lubricating oil 5 is usually applied also to the underside of the rolling stock 1 and/or to at least one lower roll 3, 4. This is not shown in FIGS. 1 and 2 simply for clarity of illustration reasons. In an analogous manner to the application of the lubricating oil 5 to the top side of the rolling stock 1 and/or to the upper working roll 3 and/or to another roll 4 arranged above the rolling stock 1, the lubricating oil 5 can also be applied in respect of the underside of the rolling stock 1 as necessary (directly) to the lower side of the rolling stock 1 and/or to the lower working roll 3 and/or to another roll 4 arranged below the rolling stock 1. Furthermore, at least one spray bar 6 is also arranged below the rolling stock 1 in this case.

Figure 3:
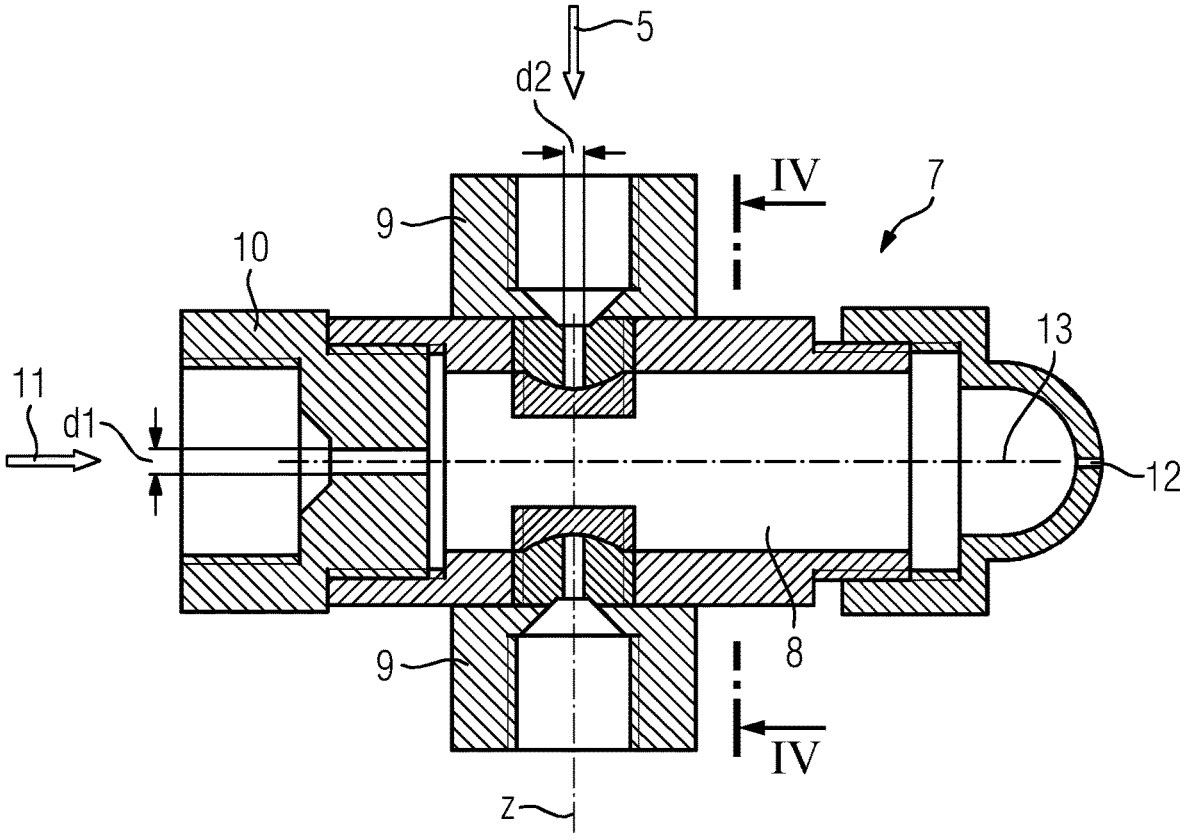
FIG. 3 shows a spray nozzle in a sectional view.

According to FIG. 3, each of the spray nozzles 7 has a mixing chamber 8. Furthermore, each of the spray nozzles 7 has a plurality of oil inlet openings 9. A minimum of two oil inlet openings 9 are present. However, there may also be more than two oil inlet openings 9 present. A respective quantity V of lubricating oil 5 is fed via the oil inlet openings 9 to the respective mixing chamber 8 per unit time. Furthermore, the mixing chambers 8 have in each case at least one air inlet opening 10. Compressed air 11 is fed to the respective mixing chamber 8 via the respective air inlet opening 10. Inside the respective mixing chamber 8, the supplied lubricating oil 5 is atomized by means of the compressed air 11 to produce an aerosol. Selection of parameters of oil and the compressed air causes the oil to be atomized in the mixing chamber. These include qualities of the oil, air pressure, quantity of oil, etc. known to the art for atomizing. The atomized lubricating oil 5 is sprayed onto the rolling stock 1 and/or the corresponding roll 3, 4 of the roll stand 2 via in each case at least one nozzle outlet 12 of the respective spray nozzle 7.

Referring to FIG. 3, the spray nozzles 7 are preferably embodied as cylindrical. They accordingly have a respective longitudinal axis 13. The nozzle outlets 12 are preferably arranged at one of the axial ends of the respective spray nozzle 7. The respective at least one air inlet opening 10 is in this case arranged at the respective other axial end of the respective spray nozzle 7.

Referred to one of the spray nozzles 7 in each case, one of the oil inlet openings 9 is arranged at a defined axial position z, viewed in the direction of the longitudinal axis 13. At least one other of the oil inlet openings 9 is arranged preferably at the same axial position z, viewed in the direction of the longitudinal axis 13. Oftentimes, even all of the oil inlet openings 9 of the respective spray nozzle 7 are arranged at the axial position z.

Referring to FIG. 3, the at least one air inlet opening 10 preferably has a diameter d1 between 0.01 mm and 5 mm. Preferably, the diameter d1 of the air inlet openings 10 is between 3 mm and 5 mm. In particular, the diameter d1 of the air inlet openings 10 may be around at least 4 mm. The oil inlet openings 9 likewise have a diameter d2. The diameter d2 of the oil inlet openings 9 is preferably between 0.1 mm and 1.0 mm. In particular, the diameter d2 of the oil inlet openings 9 typically is between 0.4 mm and 0.6 mm.

Figure 4:
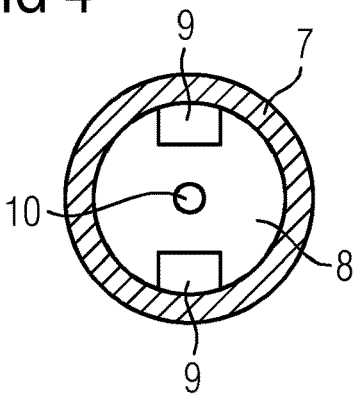
FIG. 4 shows a cross-section through the spray nozzle of FIG. 3 along a line IV-IV of FIG. 3.
Figure 5:
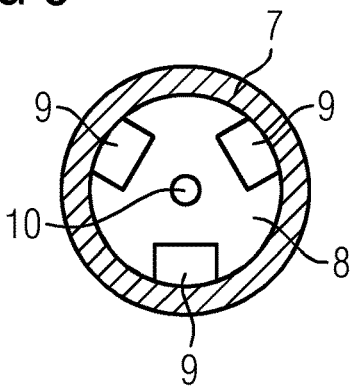
FIG. 5 shows a cross-section through a further spray nozzle corresponding to the view of FIG. 4.

In FIG. 4 for two oil inlet openings 9 and in FIG. 5 for three oil inlet openings 9, the oil inlet openings are preferably evenly distributed around the longitudinal axis 13. Referred to the longitudinal axis 13, the oil inlet openings 9 therefore preferably are at an angle of 180° apart for two oil inlet openings 9, and at an angle of 120° apart for three oil inlet openings 9. Generally, for n oil inlet openings 9, every two neighboring oil inlet openings 9 preferably form an angle of 360°/n around the longitudinal axis 13.

FIG. 2 shows an example for one of the spray nozzles 7. The lubricating oil 5 is fed to the respective mixing chamber 8 (FIG. 3) preferably in a flow-controlled manner. For this purpose, in FIG. 2, a conveying device 14 and a flow controller 15 are present. The flow controller 15 is supplied with a setpoint volume flow V* and an actual volume flow V delivered to the respective mixing chamber 8 by the conveying device 14. On the basis of the setpoint volume flow V* and the actual volume flow V, the flow controller 15 determines a control signal for the conveying device 14 in order that the actual volume flow V will be approximated to, and ideally aligned with, the setpoint volume flow V*. Owing to the conveying of the volume flow, pressure builds up in the supply line conducting the lubricating oil 5. This pressure is not controlled within the scope of the present invention. In most cases it settles between 1.5 bar and 20 bar and in particular between 2.0 bar and 15 bar.

Figure 6:
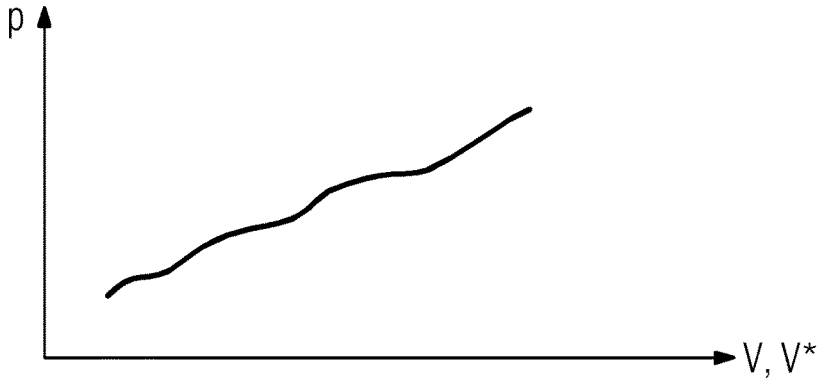
FIG. 6 shows a volume-pressure diagram.

A pressure p of the compressed air 11 fed to the respective mixing chamber 8 preferably is between 0.1 bar (=10 hPa) and 10 bar (=1000 hPa). In particular, the pressure p can be between 1.0 bar (=100 hPa) and 6.0 bar (=600 hPa). It is possible that the pressure p remains constant at the corresponding value. Preferably, however, the pressure p will be adjusted in accordance with the quantity of lubricating oil 5, i.e. as a function of one of the volume flows V, V*. FIG. 6 shows a corresponding graph to show an example. In FIG. 6, the quantity of lubricating oil 5 that is fed to the mixing chamber 8 per unit time is plotted to the right. The associated pressure p of the compressed air 11 is plotted vertically in FIG. 6. According to the graph shown in FIG. 6, it is possible in particular that the pressure p increases in line with the quantity of lubricating oil 5 that is fed to the respective mixing chamber 8 per unit time. Preferably, therefore, the following relation applies:

$$dp/dV>0$$

or $$dp/dV^*>0.$$

Figure 7:
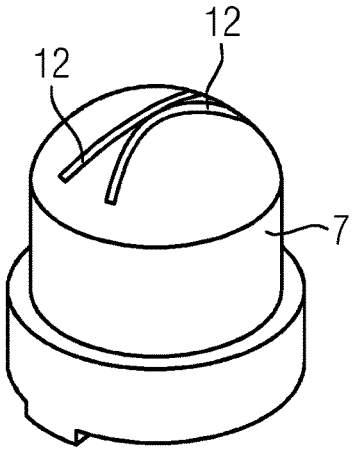
FIG. 7 shows an embodiment variant of a nozzle outlet in a perspective view.
Figure 8:
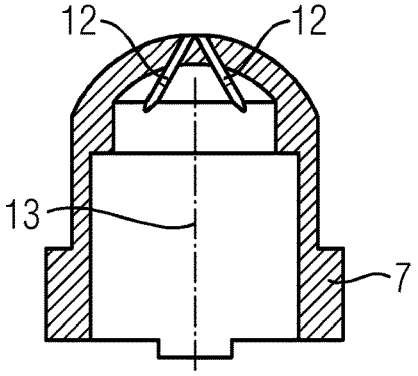
FIG. 8 shows an embodiment variant of a nozzle outlet in a sectional view, and FIGS. 9 to 11 schematically shows an arrangement of a plurality of spray nozzles in each case.

The nozzle outlets 12 can be fashioned as necessary. Preferably, the nozzle outlets 12 are in each case embodied as slit-shaped according to the illustration in FIGS. 7 and 8. In particular, the spray nozzles 7 can in each case have two nozzle outlets 12 of said type. A relatively wide, fan-like, uniform jet can be produced in a particularly simple manner by means of nozzle outlets 12 of this type.

Figure 9:
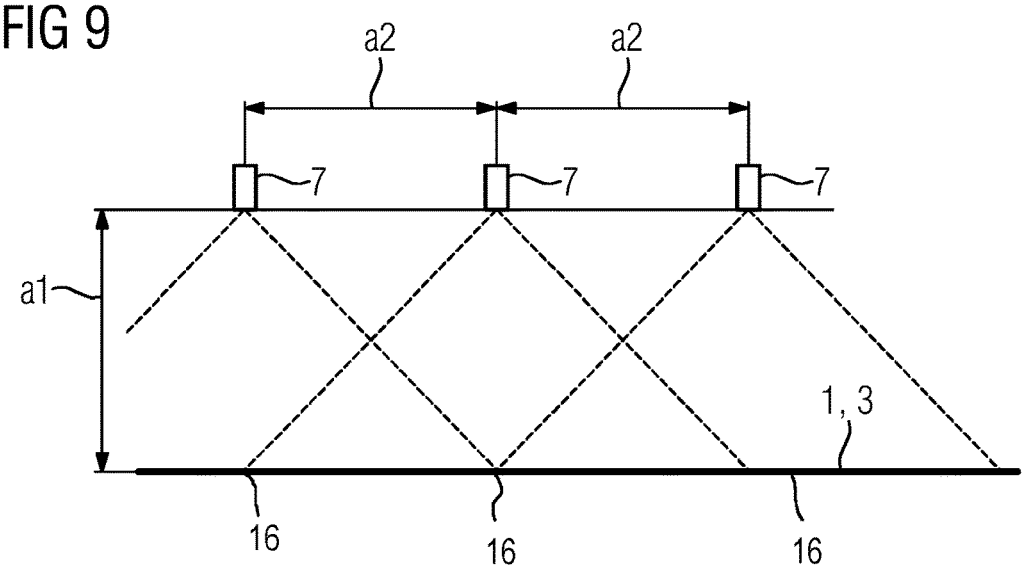

According to FIG. 9, the nozzle outlets 12 are spaced at a distance a1 from the surface onto which the lubricating oil 5 is sprayed. The surface can alternatively be a surface area of the rolling stock 1 or a surface of one of the rolls 3, 4. The distance a1 preferably is between 100 mm and 400 mm. In particular, it can lie between 150 mm and 300 mm. According to FIG. 9, the spray nozzles 7 are furthermore spaced apart from one another by a distance a2, which extends parallel to the axes of rotation 3' of the working rolls 3. The distance a2 preferably between 50 mm and 300 mm. In particular, it is between 100 mm and 200 mm.

According to FIG. 9, the lubricating oil 5 is sprayed only onto a respective subarea 16 of the rolling stock 1 and/or the corresponding roll 3, 4 by one of the spray nozzles 7 in each case. By means of the spray bar 6, i.e. the spray nozzles 7 in their totality, in contrast, the lubricating oil 5 is applied evenly to the rolling stock 1 and/or the corresponding roll 3, 4 at least over the width b1 (FIG. 2) of the rolling stock 1—often even over the full width b2 of the corresponding roll 3, 4. In order to ensure such a uniform application, the distances a1 of the nozzle outlets 12 from the rolling stock 1 or, as the case may be, from the corresponding roll 3, 4 and the distances a2 (FIG. 9) of the spray nozzles 7 from one another are set as a function of the respective spray pattern of one of the spray nozzles 7 in each case.

Depending on the circumstances of the individual case, the distances can be set in such a way that the subareas 16 assigned to immediately adjacent spray nozzles 7 have a degree of overlap of 50%. In this case, as shown in FIG. 9, the subarea 16 of one spray nozzle 7 extends to the middle of the two subareas 16 immediately adjoining the subarea 16. Referring to a specific subarea 16, there therefore exist a left-hand section and a right-hand section. Lubricating oil 5 is applied to the right-hand section also by the adjacent spray nozzle 7 on the right. Lubricating oil 5 is applied to the left-hand section also by the adjacent spray nozzle 7 on the left. Therefore, there is no section of the subarea 16 to which lubricating oil 5 is applied exclusively by the spray nozzle 7 assigned to that subarea 16.

Figure 10:
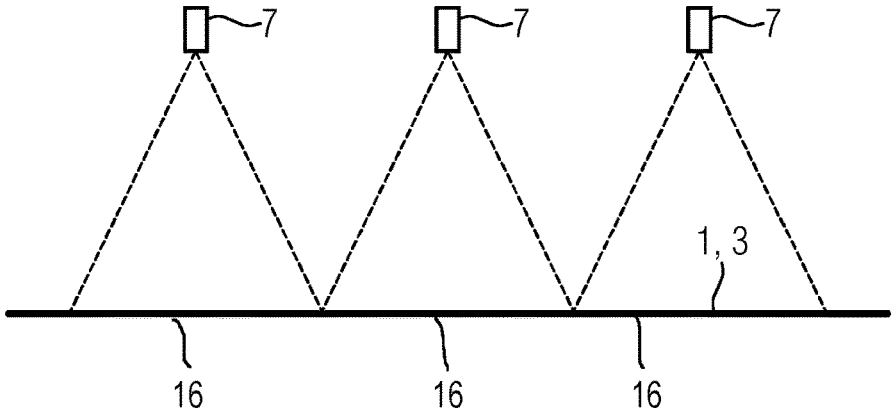

Alternatively, depending on the circumstances of the individual case, FIG. 10 shows that the distances can be set such that the subareas 16 assigned to immediately adjacent spray nozzles 7 have 0 degree overlap In FIG. 10, the subarea 16 of a specific spray nozzle 7 extends only up to the border of the two subareas 16 immediately adjoining the subarea 16. The subareas 16 adjoin one another without overlapping. There, therefore exists no section to which lubricating oil 5 is applied also by the adjacent spray nozzle 7 on the right or the left.

Figure 11:
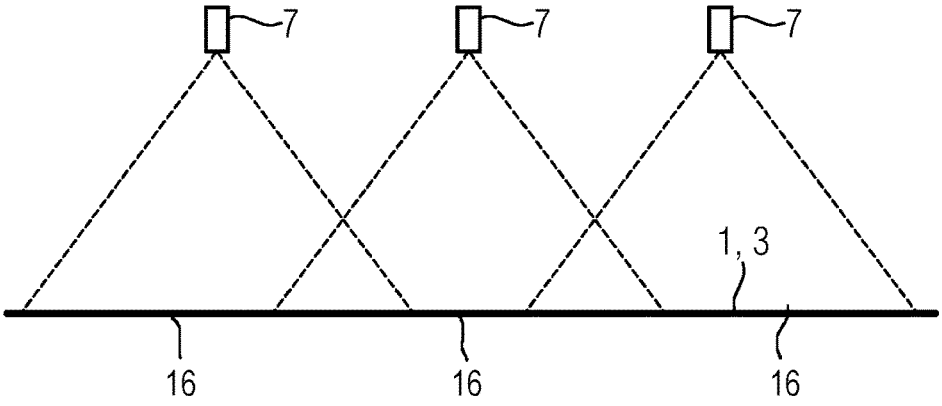

In most cases, however, the distances set are chosen in such a way that the subareas 16 assigned to immediately adjacent spray nozzles 7 have a degree of overlap that lies between the two extreme values, 0% to 50%. Referring to a specific subarea 16 in FIG. 11, there are a left-hand section and a right-hand section adjacent each other section. Lubricating oil 5 is applied to the right-hand section also by the adjacent spray nozzle 7 on the right. Lubricating oil 5 is applied to the left-hand section also by the adjacent spray nozzle 7 on the left. Between the two sections, there remains, in contrast to the embodiment of FIG. 9, a middle section of the subarea 16 to which lubricating oil 5 is applied exclusively by the respective associated spray nozzle 7. For example, the distances set can be chosen such that the subareas 16 assigned to immediately adjacent spray nozzles 7 have a degree of overlap between 15% and 40%, and in particular between 20% and 30%. FIG. 11 shows, for example, a setting of in which the degree of overlap is at approx. 25%.

To sum up, the present invention accordingly relates to the following state of affairs:

During the rolling of a flat metal rolling stock 1 in a roll stand 2, lubricating oil 5 is sprayed onto the rolling stock 1 and/or at least one roll 3, 4 of the roll stand 2 by a plurality of spray nozzles 7 arranged adjacent to one another.

In each case, a mixing chamber 8 of a spray nozzle 7 is fed with a respective quantity of lubricating oil 5 via a plurality of oil inlet openings 9. The respective mixing chamber 8 is also fed with compressed air 11 via at least one air inlet opening 10. The compressed air is at a sufficient pressure such that the lubricating oil 5 is atomized in the respective mixing chamber 8 by the compressed air 11 to form an aerosol and is then sprayed onto the rolling stock 1 and/or the at least one roll 3, 4 of the roll stand 2 via at least one nozzle outlet 12 in each case.

The present invention has numerous advantages. In particular, a wide range of adjustment of the conveyed volume flow V of lubricating oil 5 can be realized in a simple manner. Furthermore, the reliability of the spray nozzles 7 is significantly increased on account of the presence of a plurality of oil inlet openings 9. In addition, the spray pattern of the spray nozzles 7 which corresponds to the respective subarea 16, can be maintained virtually constant over the entire range of adjustment of the conveyed volume flow V. The total quantity of lubricating oil 5 required can be kept to a minimum. This is notwithstanding an oil film having a very uniform thickness produced over the entire effective width.

Although the invention has been illustrated and described in more detail on the basis of the preferred exemplary embodiment, the invention is not limited by the disclosed examples and other variations can be derived herefrom by the person skilled in the art without leaving the scope of protection of the invention.

LIST OF REFERENCE SIGNS

1 Rolling stock
2 Roll stand
3 Working rolls
3' Axes of rotation
4 Backup rolls
5 Lubricating oil
6 bar
7 Spray nozzles
8 Mixing chamber
9 Oil inlet openings
10 Air inlet opening
11 Compressed air
12 Nozzle outlets
13 Longitudinal axis
14 Conveying device
15 Flow controller
16 Subareas
a1, a2 Distances
b1, b2 Widths
d1, d2 Diameters
p Pressure
V, V* Volume flows
x Transport direction
z Axial position

The invention claimed is:

1. A method for applying a lubricating oil during rolling of a flat metal rolling stock in a roll stand comprising:

rolling the flat metal rolling stock in the roll stand wherein the roll stand includes at least one roll which rolls the rolling stock;

spraying the lubricating oil onto the rolling stock rolling past the roll stand and/or onto the at least one roll of the roll stand by a plurality of spray nozzles arranged in a series across the rolling stock, the spraying comprises:

feeding into a mixing chamber of each spray nozzle from a respective supply line a respective quantity of the lubricating oil via a respective oil inlet opening connected directly to the respective supply line that feeds the lubricating oil into the mixing chamber;

feeding the respective mixing chamber of each spray nozzle with compressed air via at least one air inlet opening into the mixing chamber for atomizing the lubricating oil in the respective mixing chamber by means of the compressed air to form an aerosol in the mixing chamber;

controlling flow of volume of the lubricating oil that is fed to the mixing chamber of each of the plurality of spray nozzles without directly controlling pressure of the lubricating oil in the respective supply line;

setting a pressure at which the compressed air is fed to the mixing chambers as a function of the volume of lubricating oil that is fed to the mixing chamber;

spraying the aerosol comprised of the lubricating oil onto the rolling stock rolling past the roll stand and/or onto the at least one roll of the roll stand via at least one nozzle outlet of each spray nozzle from the mixing chamber;

wherein the spray nozzles are cylindrical such that they each have a respective longitudinal axis, each nozzle outlet is at one axial end of the respective spray nozzle, the at least one air inlet opening is at an opposite axial end of the respective spray nozzle; and for each one of the spray nozzles, one of the oil inlet openings thereof is at a defined axial position in the direction of the longitudinal axis, and at least one other of the oil inlet openings is arranged at the same axial position in the direction of the longitudinal axis.

2. The method as claimed in claim 1, wherein the oil inlet openings of each of the spray nozzles are arranged at the defined axial position on the respective spray nozzle and the oil inlet openings are evenly distributed around the longitudinal axis on the respective spray nozzle.

3. The method as claimed claim 1, further comprising:
feeding the compressed air to the respective mixing chamber at a pressure between 0.1 bar and 10 bar.

4. The method as claimed in claim 1, further comprising increasing the pressure at which the compressed air is fed to the respective mixing chamber in line with the quantity of lubricating oil fed to the respective mixing chamber.

5. The method as claimed in claim 1, wherein the at least one air inlet opening has a diameter between 0.01 mm and 5 mm.

6. The method as claimed in claim 1, wherein each oil inlet opening has a diameter between 0.1 mm and 1.0 mm.

7. The method as claimed in claim 1, wherein each nozzle outlet is embodied as slit-shaped.

8. The method as claimed in claim 1, wherein the nozzle outlets are spaced away from the rolling stock and/or from the at least one roll onto which the lubricating oil is sprayed by the nozzle outlets, at a distance away between 100 mm and 400 mm.

9. The method as claimed in claim 1, wherein the spray nozzles are spaced apart from one another across the rolling stock by a distance between 50 mm and 300 mm.

10. The method as claimed in claim 1, further comprising spraying the lubricating oil onto the rolling stock and/or the at least one roll by each spray nozzle onto a respective subarea of the rolling stock and/or of the at least one roll, such that subareas for immediately adjacent spray nozzles have a degree of overlap that lies between 0% and 50%.

11. A device for applying a lubricating oil to flat metal rolling stock which passes a roll stand and/or to at least one roll of the roll stand during rolling of the rolling stock in the roll stand, the device comprising:
a roll stand configured to move the rolling stock through the roll stand;
a spray bar which extends across the rolling stock and parallel to an axis of rotation of the at least one roll of the roll stand;
a plurality of spray nozzles arranged adjacent to one another and along the spray bar, each spray nozzle includes a mixing chamber and a respective oil inlet opening directly connected to a respective supply line to feed lubricating oil into the mixing chamber;
at least one air inlet opening into each mixing chamber via which compressed air is fed to the respective mixing chamber for atomizing the lubricating oil to form an aerosol in the mixing chamber;
each of the spray nozzles has at least one nozzle outlet from the mixing chamber via which the lubricating oil atomized in the respective mixing chamber is sprayed onto the rolling stock and/or the at least one roll of the roll stand;
the spray nozzles are cylindrical such that they each have a respective longitudinal axis;
the at least one nozzle outlet is at one axial end of the respective spray nozzles;
the at least one air inlet opening to each mixing chamber is at another axial end of the respective spray nozzle;
one of the oil inlet openings of each of the spray nozzles is arranged at a defined axial position along the direction of the longitudinal axis, and at least one other of the oil inlet openings is at the same defined axial position, viewed along the direction of the longitudinal axis; and
a conveying device; and
a flow controller;
wherein the flow controller determines a control signal for the conveying device based on a set point volume flow of the lubricating oil and an actual volume flow of the lubricating oil to the mixing chambers to control volume flow of the lubricating oil to the mixing chambers without directly controlling a pressure of the lubricating oil in the supply lines.

12. The device as claimed in claim 11, wherein the oil inlet openings arranged at the defined axial position are uniformly distributed around the longitudinal axis.

13. The device as claimed in claim 11, wherein the at least one air inlet opening has a diameter between 0.01 mm and 5 mm.

14. The device as claimed in claim 11, wherein the oil inlet openings have a diameter between 0.1 mm and 1.0 mm.

15. The device as claimed in claim 11, wherein the nozzle outlets are slit shaped.

16. The device as claimed in claim 11, wherein the nozzle outlets are spaced away from the rolling stock and/or from the at least one roll onto which the lubricating oil is sprayed by the nozzle outlets at a distance between 100 mm and 400 mm.

17. The device as claimed in claim 11, wherein the spray nozzles are spaced apart from one another across the rolling stock by a distance between 50 mm and 300 mm.

18. The device as claimed in claim 11, wherein the at least one nozzle outlet of each spray nozzle is configured to spray the lubricating oil onto a respective subarea, and the immediately adjacent subareas have a degree of overlap that lies between 0% and 50%.

* * * * *